US011567425B2

(12) United States Patent
Kawasumi et al.

(10) Patent No.: US 11,567,425 B2
(45) Date of Patent: Jan. 31, 2023

(54) DEVELOPING DEVICE, AND IMAGE FORMING APPARATUS INCLUDING THE SAME

(71) Applicant: KYOCERA Document Solutions Inc., Osaka (JP)

(72) Inventors: Takuya Kawasumi, Osaka (JP); Masakazu Uehara, Osaka (JP); Rei Yamagishi, Osaka (JP); Hiroaki Kitagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/701,445

(22) Filed: Mar. 22, 2022

(65) Prior Publication Data

US 2022/0342340 A1 Oct. 27, 2022

(30) Foreign Application Priority Data

Apr. 27, 2021 (JP) ..... JP2021-074708

(51) Int. Cl.
*G03G 15/08* (2006.01)

(52) U.S. Cl.
CPC ..... *G03G 15/08* (2013.01)

(58) Field of Classification Search
CPC ..... G03G 15/08; G03G 21/1676
See application file for complete search history.

(56) References Cited

U.S. PATENT DOCUMENTS

| | | | | |
|---|---|---|---|---|
| 7,428,386 | B2 * | 9/2008 | Itabashi | G03G 15/0868 399/119 |
| 8,326,178 | B2 * | 12/2012 | Nakamura | G03G 21/1832 399/116 |
| 2011/0103835 | A1 * | 5/2011 | Hayashi | G03G 15/0121 399/119 |
| 2011/0233093 | A1 * | 9/2011 | Fujii | G03G 15/0822 206/446 |
| 2015/0139693 | A1 * | 5/2015 | Shimizu | G03G 21/1647 399/119 |

FOREIGN PATENT DOCUMENTS

JP 2018-091892 A 6/2018

* cited by examiner

*Primary Examiner* — Francis C Gray
(74) *Attorney, Agent, or Firm* — Stein IP, LLC

(57) ABSTRACT

The developing device includes a development container, a developer carrier, and a cover member. The development container has an opening. The developer carrier has a development area. The cover member, including a front face portion, an upper face portion, a lower face portion, a side face portion, and reinforcing ribs, is removably fitted to the development container such that the developer carrier is covered with at least the front face portion and the upper face portion. With the cover member fitted to the development container, a gap is formed between each reinforcing rib and the development container.

7 Claims, 7 Drawing Sheets

DEVELOPING DEVICE, AND IMAGE FORMING APPARATUS INCLUDING THE SAME

INCORPORATION BY REFERENCE

This application is based upon and claims the benefit of priority from the corresponding Japanese Patent Application No. 2021-074708 filed on Apr. 27, 2021, the entire contents of which are incorporated herein by reference.

BACKGROUND

The present disclosure relates to a developing device and an image forming apparatus including the developing device.

Image forming apparatuses, such as copiers, printers, facsimiles, and multifunction peripherals in combination of those devices, with use of the electrophotographic system, are equipped with a developing device for developing an electrostatic latent image formed on an outer circumferential surface of an image carrier, i.e., for forming a toner image (visible image) elicited from an electrostatic latent image Among such developing devices as described above is one which includes a development container and a developer carrier. The development container contains developer including toner. The developer carrier is placed in contact with or proximity to an image carrier. The developer carrier carries, on its outer circumferential surface, developer (toner) contained in the development container.

The development container has a container opening formed therein. The container opening is opened downstream of the development container as viewed in a moving direction (a direction in which the developing device is moved inside an image forming apparatus under a condition that the developing device has been fitted to the image forming apparatus). The developer carrier is placed so as to overlap with the container opening. Part of the developer carrier is exposed outside the developing device through the container opening. The part of the developer carrier exposed from the container opening is opposed to the image carrier, and there is formed a development area where toner within the development container is fed to the image carrier.

In the image forming apparatus including such a developing device as described above, a body opening is formed in upper portion of a main body (apparatus body) of the image forming apparatus. The body opening leads from inside to outside of the apparatus body. Guide rails are provided inside the apparatus body. The guide rails guide the developing device from the body opening to a fitting position of the developing device. The developing device is moved along these guide rails from the body opening to the fitting position within the apparatus body.

Among such developing devices as described above is one which includes a cover member. In order to protect the developer carrier during transport or storage of the developing device, the cover member is removably fitted to the development container so as to cover the developer carrier. The cover member has been fitted to the development container at a stage of shipping of the developing device, and is removed from the development container when the developing device is fitted to the image forming apparatus.

Such a cover member as described above is, in general, formed into a shape composed of a plurality of relatively thin planes for weight reduction. In such a cover, reinforcement-dedicated ribs are formed on an inner-side (fitting-side to the container opening) surface. These ribs serve to suppress any deformation due to shocks during transport or, in a case of resinous make, suppress thermal contraction during molding. The ribs are so configured as to come into contact with specified spots of the development container under a condition that the cover member has been fitted to the container opening. Thus, the cover member can also be fitted to the container opening while having been positioned at a proper place.

SUMMARY

This and other objects of the present disclosure, and the specific benefits obtained according to the present disclosure, will become apparent from the description of an embodiment which follows. A developing device according to one aspect of the present disclosure includes a development container, a developer carrier, and a cover member. The development container, having an opening, internally contains developer including toner. The developer carrier, rotatably supported by the development container, has a development area where part of its outer circumferential surface carrying the developer is exposed from the opening, and the developer carrier feeds toner to the image carrier in the development area. The cover member is fittable to and removable from the development container, and protects the outer circumferential surface of the developer carrier exposed from the opening. The cover member includes a front face portion opposed to an entire range of the developer carrier in its rotation-axial direction, an upper face portion and a lower face portion which are erectly provided over a range from a side end portion extending along the rotation-axial direction of the front face portion toward the development container and which are opposed to each other with the developer carrier interposed therebetween, a side face portion erectly provided from one end edge of the front face portion in the rotation-axial direction toward the development container, and reinforcing ribs formed in coupling portion between the lower face portion and the front face portion. The cover member is removably fitted to the development container such that the developer carrier is converted with at least the front face portion and the upper face portion. With the cover member fitted to the development container, a gap is formed between each reinforcing rib and the development container.

DETAILED DESCRIPTION

Figure 1:
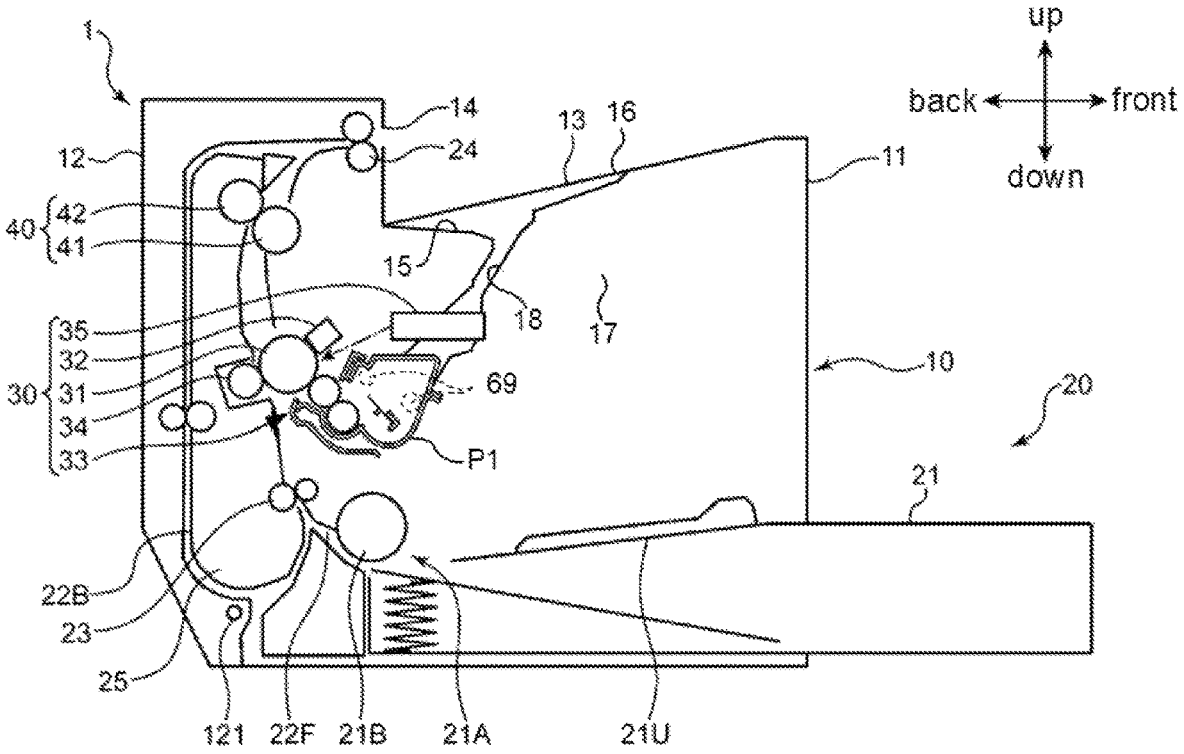
FIG. 1 is a side sectional view showing a schematic configuration of an image forming apparatus 1 of the present disclosure.

Hereinbelow, an embodiment of the present disclosure will be described with reference to the accompanying drawings. FIG. 1 is a side sectional view showing a schematic configuration of an image forming apparatus 1 of the disclosure. It is noted that right side in FIG. 1 is assumed as front side of the image forming apparatus 1 and left side in FIG. 1 is assumed as rear side of the image forming apparatus 1. Also, upper side in FIG. 1 is assumed as upper side of the image forming apparatus 1, and lower side in FIG. 1 is assumed as lower side of the image forming apparatus 1.

As shown in FIG. 1, the image forming apparatus 1 (monochrome printer in this case) includes a body housing 10 (apparatus main body), a sheet feed part 20, an image forming part 30, a developing device 33, and a fixing part 40. The body housing 10 has a casing structure of a generally rectangular parallelepiped shape. The sheet feed part 20 is housed in the body housing 10.

The body housing 10 is equipped with a front cover 11, a rear cover 12, a body opening 15, and an upper cover 16. The front cover 11 is located on a front-face side of the body housing 10. The rear cover 12 is located on a rear-face side of the body housing 10. The body opening 15 is formed in upper portion of the body housing 10. The upper cover 16 is provided at a top face of the body housing 10. The upper cover 16 is enabled to open and close the body opening 15. Opening the upper cover 16 allows a user to access inside of the body housing 10 through the body opening 15.

A sheet discharge part 13 to which a sheet (recording medium) over image formation is to be discharged is provided on an upper surface of the upper cover 16. At an upper site of the body housing 10, a sheet discharge port 14 is provided in front-and-rear opposition to the sheet discharge part 13. The sheet discharge port 14 is an opening leading to inside of the housing 10. It is noted that the term 'sheet' hereinafter refers to copying paper, coated paper, OHP sheets, cardboards, postcards, tracing paper, and other sheet materials for image formation process.

The developing device 33 can be set into and out of the body opening 15 under a condition that the upper cover 16 is opened. Individual units (except the developing device 33) of the image forming part 30 and the fixing part 40 can be set into and out of the body housing 10 from its rear-face side under a condition that the rear cover 12 is opened.

The sheet feed part 20 includes a sheet feed cassette 21. The sheet feed cassette 21 contains sheets to be subjected to image formation process. Part of the sheet feed cassette 21 is protruded forward of a front face of the body housing 10. A top face of a housed portion of the sheet feed cassette 21 housed within the body housing 10 is covered with a sheet-feed-cassette top plate 21U.

The sheet feed cassette 21 includes a sheet containing space in which a bundle of sheets is to be contained, a lift plate for lifting up a bundle of sheets for sheet feeding, and the like. A sheet feed-out part 21A is provided at a rear-end side upper position of the sheet feed cassette 21. A sheet feed roller 21B for feeding out sheets, one by one, of a topmost layer of a sheet bundle in the sheet feed cassette 21 is placed in the sheet feed-out part 21A.

The image forming part 30 performs image forming operation. The image forming operation is an operation of forming a toner image (developer image) on a sheet fed out from the sheet feed part 20. The image forming part 30 includes a photosensitive drum 31, and other members disposed around the photosensitive drum 31 such as a charging unit 32, an exposure unit 35, the developing device 33, and a transfer roller 34. The developer used for image formation is nonmagnetic one-component developer composed of toner alone.

The photosensitive drum 31 (image carrier) includes a rotating shaft, and an outer circumferential surface rotatable around the rotating shaft. A photosensitive layer formed from a well-known organic photoconductor (OPC) and having an outer circumferential surface composed of a charge generation layer, a charge transport layer or the like, as an example, is formed at an outer circumferential surface of the photosensitive drum 31. The photosensitive layer, after uniformly charged by a later-described charging unit 32, is illuminated by the exposure unit 35, by which an electrostatic latent image with charging level attenuated is formed. Then, a toner image elicited from the electrostatic latent image by the developing device 33 is carried thereon.

The charging unit 32 (charging device), which is placed with a specified gap to the outer circumferential surface of the photosensitive drum 31, electrically charges uniformly, in a noncontact state, the outer circumferential surface of the photosensitive drum 31. More specifically, the charging unit 32 includes a charging wire 321 and a grid electrode 322 (see FIG. 3 for both). The charging wire 321, which is a linear electrode extending along a rotation-axial direction of the photosensitive drum 31, generates corona discharge against the photosensitive drum 31. The grid electrode 322, which is a grid-shaped electrode extending along the rotation-axial direction of the photosensitive drum 31, is disposed between the charging wire 321 and the photosensitive drum 31.

The charging unit 32 makes a current flow of a specified current value through the charging wire 321 to thereby generate corona discharge. Moreover, the charging unit 32 applies a specified voltage to the grid electrode 322 so that the outer circumferential surface of the photosensitive drum 31 opposed to the grid electrode 322 is charged uniformly to a specified surface potential.

The exposure unit 35 (exposure device) includes a laser light source and optical equipment such as a mirror and a lens. The exposure unit 35 applies, to the outer circumferential surface of the photosensitive drum 31, light modulated based on image data given from an external device such as a personal computer. As a result, on the outer circumferential surface of the photosensitive drum 31, the exposure unit 35 forms an electrostatic latent image corresponding to an image based on the image data.

The transfer roller 34 includes a rotating shaft parallel to a widthwise direction of a sheet, and an outer circumferential surface opposed to the outer circumferential surface of the photosensitive drum 31. The transfer roller 34 is supported by the body housing 10 so as to be rotatable around the rotating shaft. The transfer roller 34 transfers a toner image carried on the outer circumferential surface of the photosensitive drum 31 to a sheet passing through a nip portion against the outer circumferential surface of the photosensitive drum 31. During this transfer, a transfer voltage opposite in polarity to toner is applied to the transfer roller 34.

The fixing part 40, which is located sheet-conveyance downstream of the transfer roller 34, fixes the toner image, which has been transferred to the sheet, on the sheet. The fixing part 40 includes a fixing roller 41 and a pressure roller 42. The fixing roller 41, including a heat source inside, heats the toner transferred to the sheet to a specified temperature.

The pressure roller 42, set in pressure contact with the fixing roller 41, forms a fixing nip portion against the fixing roller 41. When the sheet to which a toner image has been transferred is passed through the fixing nip portion, the toner image is fixed on the sheet by means of heating by the fixing roller 41 and pressurization by the pressure roller 42.

The body housing 10 is internally equipped with a main conveyance path 22F and a reversal conveyance path 22B. The main conveyance path 22F and the reversal conveyance path 22B convey a sheet. The main conveyance path 22F extends from the sheet feed-out part 21A of the sheet feed part 20, via the image forming part 30 and the fixing part 40, up to the sheet discharge port 14. The reversal conveyance path 22B is a conveyance path for, in a case of double-sided printing with a sheet, returning the sheet, which has been subjected to one-side printing, to upstream side of the image forming part 30 in the main conveyance path 22F.

The main conveyance path 22F extends so as to pass from below toward above through a transfer nip portion formed by the photosensitive drum 31 and the transfer roller 34. Also, a registration roller pair 23 is placed upstream of the transfer nip portion in the main conveyance path 22F. The sheet is once stopped by the registration roller pair 23, then subjected to skew correction and subsequently fed out to the transfer nip portion at a specified timing for image transfer. A plurality of conveyance rollers for conveying a sheet are placed on the main conveyance path 22F and the reversal conveyance path 22B. A sheet discharge roller pair 24 is placed near the sheet discharge port 14.

The reversal conveyance path 22B is formed between an outer surface of a reversal unit 25 and an inner surface of the rear cover 12 of the body housing 10. It is noted that the transfer roller 34 and one roller of the registration roller pair 23 are mounted on an inner surface of the reversal unit 25. The rear cover 12 and the reversal unit 25 are each pivotable around an axis of a fulcrum part 121 provided at a lower end of those members. In an event of jam (paper jamming) in the reversal conveyance path 22B, the rear cover 12 is opened. In an event of j am in the main conveyance path 22F or when a unit of the photosensitive drum 31 or the developing device 33 is to be removed outside, not only the rear cover 12 but also the reversal unit 25 are opened.

As shown in FIG. 1, in the body housing 10, guide rails 18 are formed at a pair of side surfaces 17 opposed to each other in the sheet widthwise direction (drawing-sheet direction in FIG. 1). The guide rails 18 have a rail structure recessed in the sheet widthwise direction. The guide rails 18 extend downward from the body opening 15 to a fitting position P1 where the developing device 33 is fitted to the body housing 10.

Figure 2:
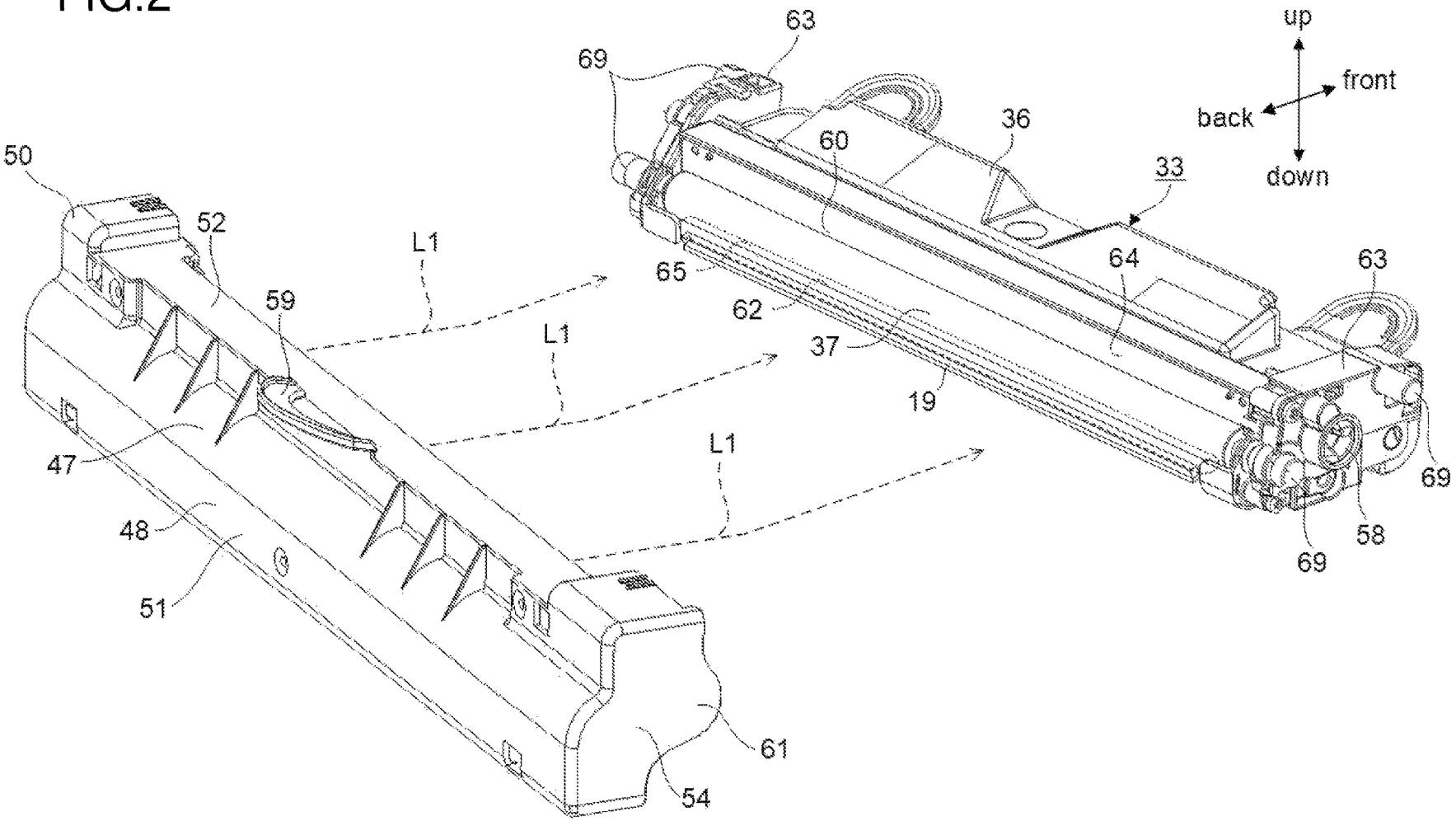
FIG. 2 is a perspective view showing an entirety of a developing device 33.
Figure 3:
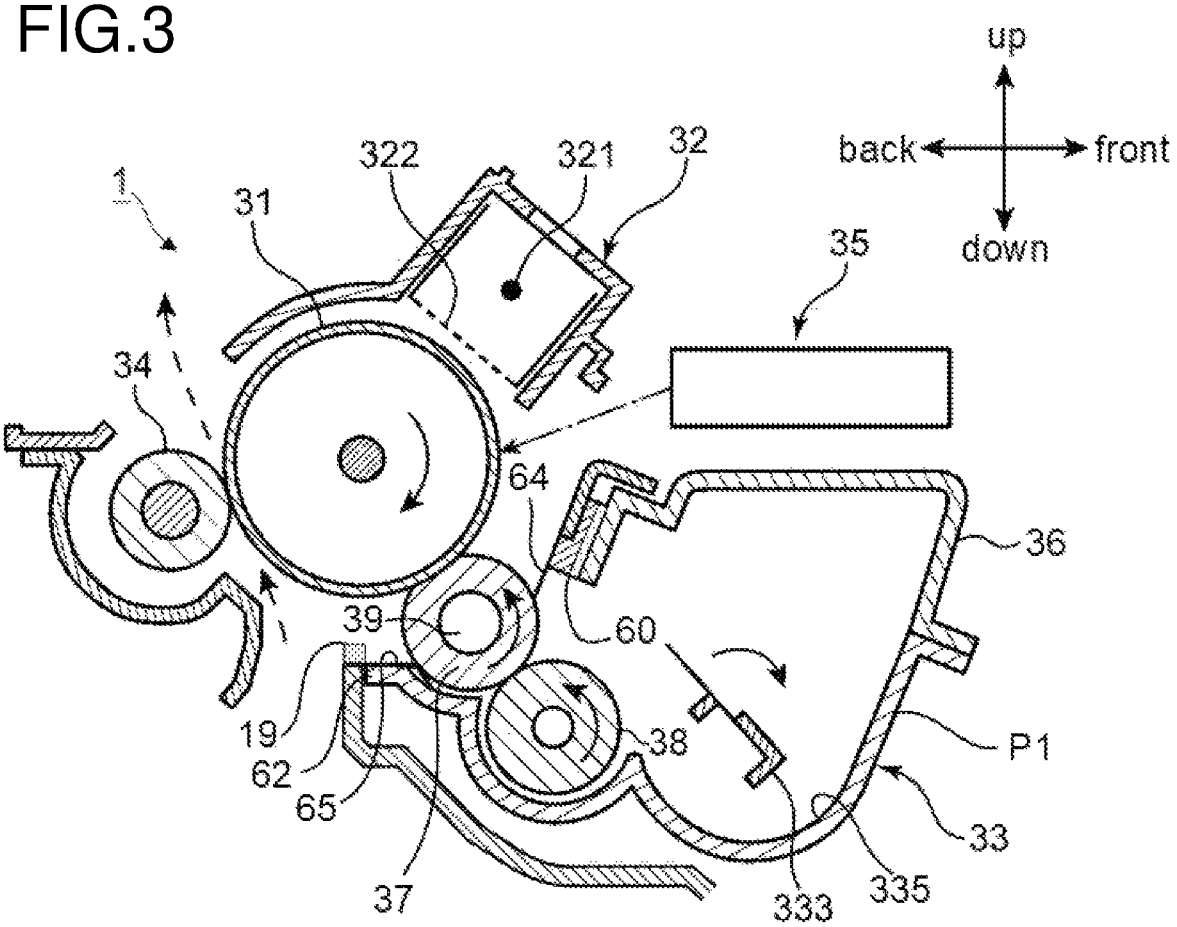
FIG. 3 is an enlarged sectional view in which a cross section of a vicinity of a photosensitive drum 31 and the developing device 33 in its fitted state to the image forming apparatus 1 is enlarged.

FIG. 2 is a perspective view showing an entirety of the developing device 33. FIG. 3 is an enlarged sectional view in which a cross section of a vicinity of the photosensitive drum 31, as well as the developing device 33 as it is fitted to the image forming apparatus 1, is enlarged.

As shown in FIGS. 2 and 3, the developing device 33 includes a development container 36, a developing roller 37 (developer carrier), a feed roller 38, a stirring paddle 333, guide parts 69, and a cover member 50.

The development container 36 internally contains nonmagnetic one-component developer composed of toner alone and also contains the developing roller 37, the feed roller 38, and the like. The development container 36 includes a stirring chamber 335 and a container opening 60 (opening). The stirring chamber 335 contains developer in a stirred state. Side frames 63 are fitted at both end portions of the development container 36 as viewed in a widthwise direction (later-described axial direction) of the developing device 33.

The container opening 60 is a rectangular-shaped through hole opened on a rear side (a side closer to the photosensitive drum 31) of the development container 36. The container opening 60 is formed elongated in the widthwise direction of the developing device 33.

The developing roller 37 is provided inside the container opening 60 so as to overlap with the container opening 60. Part of an outer circumferential surface of the developing roller 37 is exposed from the container opening 60 outward of the development container 36. The developing roller 37 includes a rotating shaft 39 extending along the widthwise direction of the developing device 33. The rotating shaft 39 is rotatably supported by the development container 36. In other words, the developing roller 37 is supported by the development container 36 via the rotating shaft 39 so as to be rotatable clockwise around the rotating shaft 39 as in the figure (see FIG. 3). It is noted that hereinafter, a direction along the rotating shaft 39 will be referred to as 'axial direction'.

The developing roller 37 is enabled to carry toner on its outer circumferential surface. While the developing device 33 is in the fitting position P1, the part of the developing roller 37 exposed out of the container opening 60 and the outer circumferential surface of the photosensitive drum 31 are opposed to each other in a contact or closeness state. In this state, the developing roller 37 is enabled to feed the nonmagnetic one-component toner (developer) to the photosensitive drum 31.

The feed roller 38 is provided between the developing roller 37 and the stirring paddle 333. The feed roller 38 feeds the nonmagnetic one-component toner (developer) to the outer circumferential surface of the developing roller 37. The stirring paddle 333, which is provided in the stirring chamber 335, stirs the developer inside the stirring chamber 335.

The side frames 63 rotatably support the rotating shaft 39 of the developing roller 37 and a rotating shaft of the feed roller 38. One of the paired side frames 63 is equipped with a drive input gear 58 for inputting rotation driving force to the rotating shaft 39 of the developing roller 37.

The drive input gear 58 is coupled to the rotating shaft 39 of the developing roller 37 from outside of the side frame 63 (not shown). With the developing device 33 fitted to the image forming apparatus 1, the drive input gear 58 is coupled to a drive system (a gear train including a motor and the like) provided at a specified position inside the image forming apparatus 1. In this state, the drive input gear 58 transmits the rotation driving force of the drive system to the rotating shaft 39 of the developing roller 37. As a result, the developing roller 37 is rotated around the rotating shaft 39. Grease or other lubricant is applied to the drive input gear 58 for smooth transmission of the rotation driving force.

Each guide part 69 is a cylindrical-shaped protrusion protruded from the side frame 63. The guide parts 69 are engageable with the guide rails 18. With the guide parts 69 engaged with the guide rails 18, the developing device 33 is movable along the guide rails 18 between the body opening 15 and the fitting position P1.

The developing device 33, while fitted to the body housing 10 in the fitting position P1, feeds toner to the outer circumferential surface of the photosensitive drum 31. As a result, an electrostatic latent image formed on the outer circumferential surface of the photosensitive drum 31 is developed (a toner image (visible image) elicited from an electrostatic latent image is formed).

As shown in FIGS. 2 and 3, provided around the container opening 60 are a flat portion 62 located on a rear side (a side closer to the photosensitive drum 31) of the container opening 60, a front seal member 65 provided on the flat portion 62, and a restricting blade 64 fixed at a rear-side end portion of the development container 36.

The flat portion 62 is a plane adjacently connecting with a part of the inner surface of the development container 36 that is located under the developing roller 37. The flat portion 62 extends rearward (a direction nearing to the photosensitive drum 31) from the container opening 60. While the developing device 33 is in the fitting position P1, the flat portion 62 remains generally horizontal.

The front seal member 65 is a rectangular-shaped sheet formed from PET film or the like. The front seal member 65 is layered on the flat portion 62 and bonded to the development container 36 with adhesive or the like. The front seal member 65 is formed elongated in the axial direction. The front seal member 65 extends between both end portions 66 of the developing roller 37 along the axial direction.

Out of both end edges of the front seal member 65 in the front/rear direction (a direction perpendicular to the sheet widthwise direction), one end edge closer to the developing roller 37 (feed roller 38) is in contact with an entire range of a developer-carrying area out of the outer circumferential surface of the developing roller 37 as viewed in the axial direction. The front seal member 65, by its contacting the outer circumferential surface of the developing roller 37, blocks a gap between the development container 36 and the developing roller 37, thereby suppressing outflow of the developer contained in the development container 36.

The front seal member 65 includes a shielding portion 19. The shielding portion 19 is provided at one end edge of the front seal member 65 farther from the developing roller 37 (feed roller 38) out of both end edges of the front seal member 65 in the front/rear direction (a direction perpendicular to the sheet widthwise direction). The shielding portion 19 is raised in a planar direction of the front seal member 65. The shielding portion 19 is protruded upward over an entire axial range of an end edge of the front seal member 65. The shielding portion 19 has a square shape formed from sponge or the like. The shielding portion 19 is bonded to a surface of the front seal member 65 with adhesive or the like. The shielding portion 19 holds a slight amount of developer having flowed out of the gap between the developing roller 37 and the development container 36 so that the slight amount of developer is kept from dropping outward of the developing device 33.

The restricting blade 64 is a rectangular-shaped platy matter which is formed elongated in the axial direction. The restricting blade 64 is provided upward of an opening edge of the container opening 60 so as to be protruded toward the developing roller 37. A tip end portion of the restricting blade 64 in its protrusive direction is placed in contact with the outer circumferential surface of the developing roller 37. Toner fed onto the developing roller 37 enters in between the restricting blade 64 and the developing roller 37 along with rotation of the developing roller 37 and then, while being frictionally charged, is carried on the developing roller 37 as a thin layer of a certain thickness.

Figure 4:
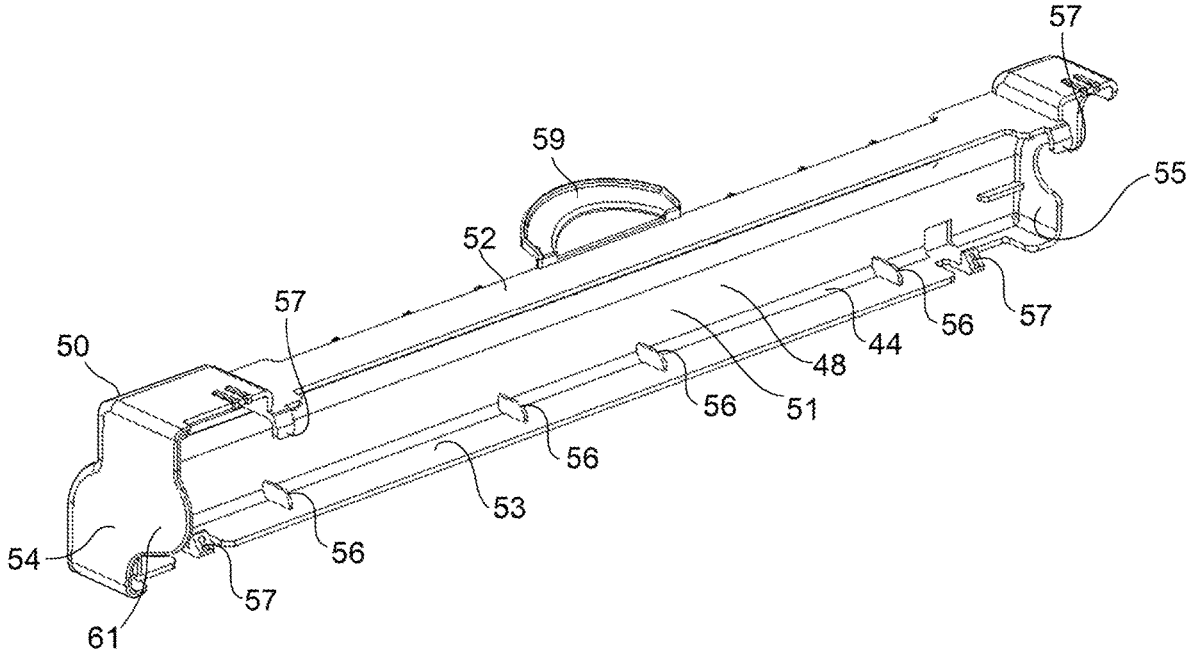
FIG. 4 is a perspective view of a cover member 50 as it is viewed from inside.
Figure 5:
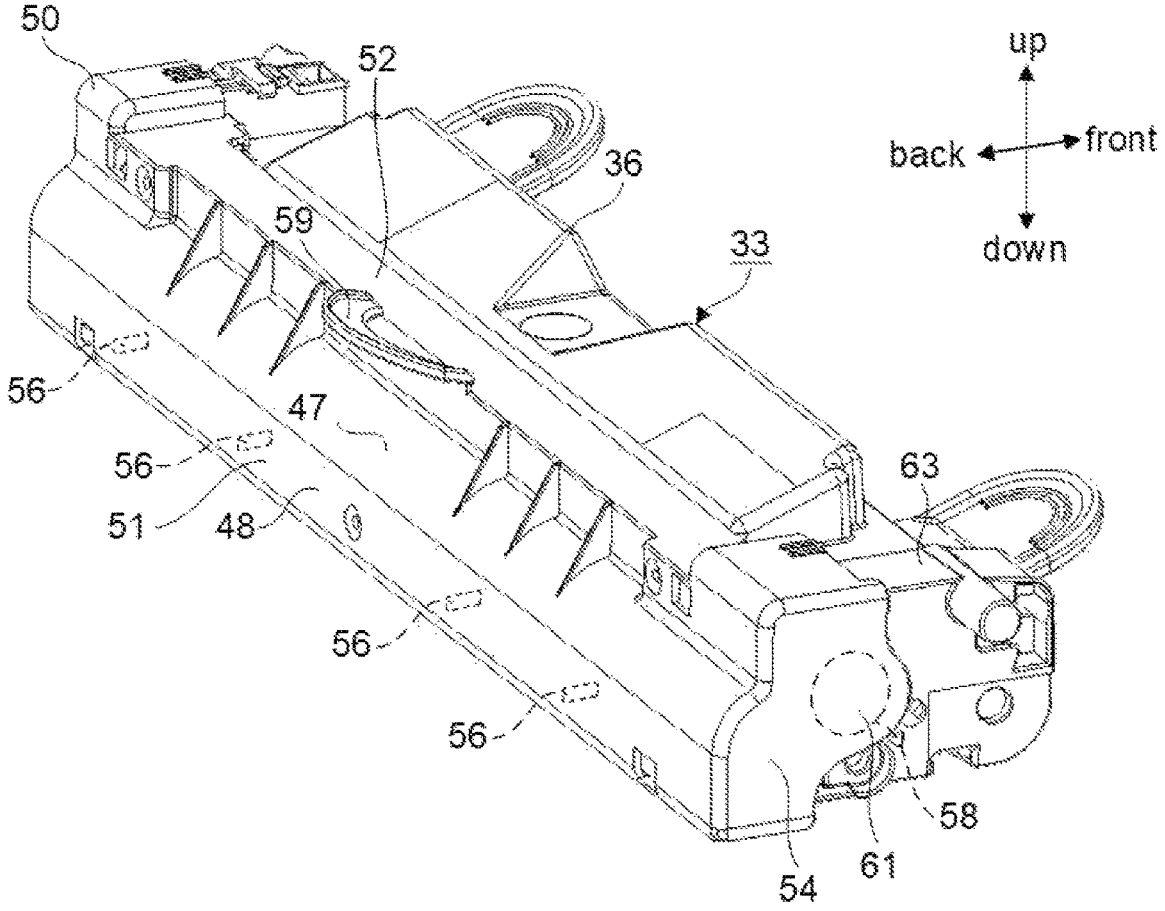
FIG. 5 is a perspective view showing an entirety of the developing device 33 with the cover member 50 fitted thereto.
Figure 6:
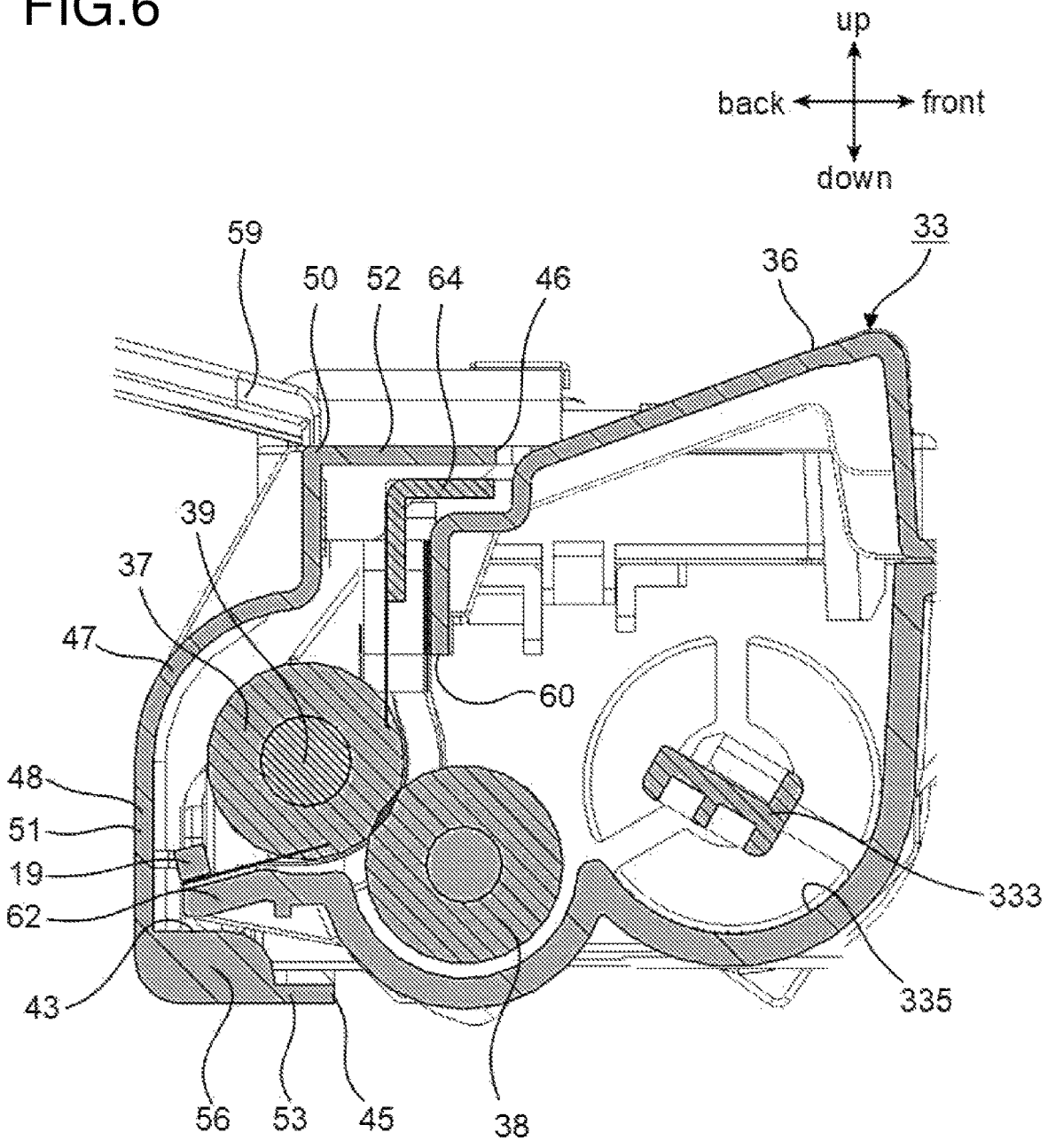
FIG. 6 is a sectional view showing a cross section of the developing device 33 perpendicular to its axial direction as it is cut at a position overlapping with reinforcing ribs 56 in the axial direction.
Figure 7:
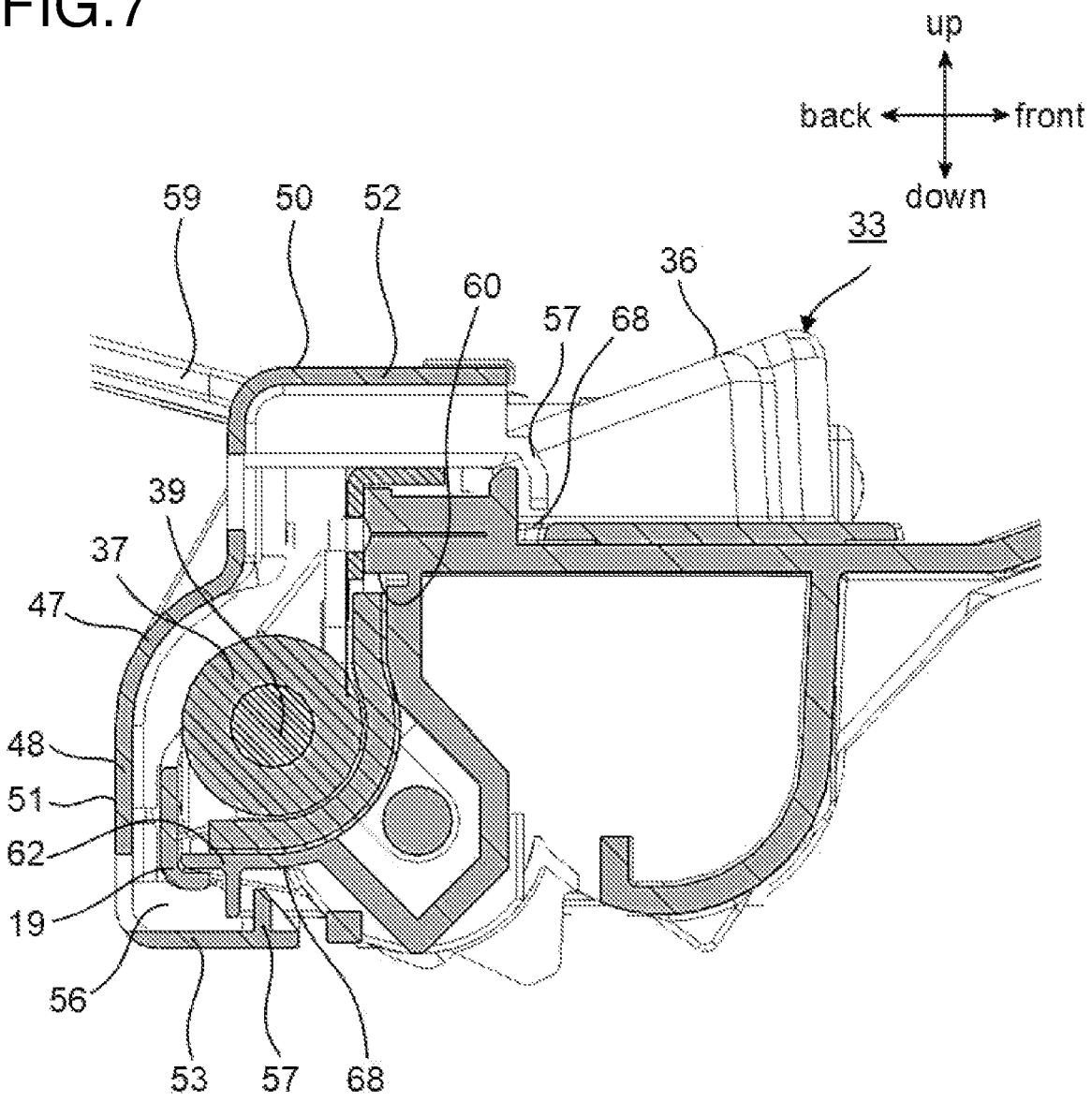
FIG. 7 is a sectional view showing a cross section of the developing device 33 perpendicular to the axial direction as it is cut at a position overlapping with an engaging protrusion 57 in the axial direction.

FIG. 4 is a perspective view of the cover member 50 as it is viewed from inside. FIG. 5 is a perspective view showing an entirety of the developing device 33 with the cover member 50 fitted thereto. FIG. 6 is a sectional view showing a cross section of the developing device 33 perpendicular to its axial direction as it is cut at a position overlapping with reinforcing ribs 56 in the axial direction. FIG. 7 is a sectional view showing a cross section of the developing device 33 perpendicular to the axial direction as it is cut at a position overlapping with an engaging protrusion 57 in the axial direction.

The cover member 50 is fitted to the developing device 33 so as to be fittable and removable in the front/rear direction. As shown in FIGS. 4, 5 and 6, the cover member 50 is a square-shaped box-like matter formed by including a front face portion 51, an upper face portion 52, a lower face portion 53, and side face portions 54, 55. The cover member 50 is formed from resin. It is noted that hereinafter, a fitting direction (arrows L1 marked in FIG. 2) of the cover member 50 to the development container 36 will be referred to as 'fitting direction'. Also hereinafter, a state in which the cover member 50 is fitted to the development container 36 will be referred to as 'fitted state'.

The front face portion 51 is a surface located at an upstream-side end portion of the cover member 50 in its fitting direction. The front face portion 51 is composed of a flat face portion 48 and a curved portion 47. The flat face portion 48 is formed elongated in the axial direction. The curved portion 47 is curved along the outer circumferential surface of the developing roller 37. The curved portion 47 is adjacently connected to a side edge of the flat face portion 48 extending along the axial direction.

The flat face portion 48 is a rectangular-shaped surface generally perpendicular to the axial direction and the fitting direction. In the fitted state, the flat face portion 48 is opposed to the developing roller 37 and the shielding portion 19 in the front/rear direction. Also in the fitted state, a gap is formed between the flat face portion 48 and the shielding portion 19 as viewed in the front/rear direction. In the fitted state, an axial side edge (lower end edge) of the flat face portion 48 is located lower than the flat portion 62. Also in the fitted state, the curved portion 47 is opposed to the outer circumferential surface of the developing roller 37 and the radial direction of the developing roller 37.

The upper face portion 52 and the lower face portion 53 are flat platy matters extending along the fitting direction. The upper face portion 52 and the lower face portion 53 are adjacently connected to side edges of the front face portion 51 extending along the axial direction. More specifically, the upper face portion 52 is adjacently connected to a side edge of the curved portion 47 extending along the axial direction (a side edge located on one side opposite to the flat face portion 48 side). The lower face portion 53 is adjacently connected to a side edge of the flat face portion 48 along the axial direction (a side edge located on one side opposite to the curved portion 47 side).

In the fitted state, a fore end portion 46 of the upper face portion 52 in the fitting direction (an end portion on the downstream side of the fitting direction) is located forward of the restricting blade 64. Also in the fitted state, a fore end portion 45 of the lower face portion 53 in the fitting direction (an end portion on the downstream side of the fitting direction) is located forward of the shielding portion 19. The upper face portion 52 and the lower face portion 53 are opposed to each other in the up/down direction with the developing roller 37 interposed therebetween.

In a coupling portion 44 corresponding to an interior angle between the flat face portion 48 and the lower face portion 53, a plurality of reinforcing ribs arrayed in the axial direction are formed. Each reinforcing rib 56 is a flat platy matter perpendicular to the axial direction. The reinforcing rib 56 is protruded from the lower face portion 53 in its planar direction (upward direction) as well as from the flat face portion 48 in its planar direction (fitting direction). In the fitted state, a fitting-direction downstream-side end portion of the reinforcing rib 56 is located forward of the shielding portion 19. An upper end portion 43 of the reinforcing rib 56 (a fore end portion of the reinforcing rib 56 in the planar direction of the lower face portion 53) is located at an even lower position than a lower portion of the flat portion 62 of the development container 36. That is, as viewed in the up/down direction, a gap is formed between the upper end portion 43 of the reinforcing rib 56 and the development container 36.

The side face portions 54, 55 are protruded in the fitting direction from axial both end portions of the front face portion 51. The side face portions 54, 55 extend in the up/down direction so as to couple the upper face portion 52 and the lower face portion 53 to each other. In the fitted state, the side face portions 54, 55 are located outside axial both end portions of the development container 36. In other words, in the fitted state, the developing roller 37 is located between the side face portions 54, 55 in the axial direction. Therefore, in the fitted state, the developing roller 37 is covered with the upper face portion 52, the lower face portion 53, and the side face portions 54, 55.

One side face portion 54 (a side face portion closer to a drawing-sheet viewer of FIGS. 4, 5 and 6) includes a counter-to-gear portion 61 which is axially opposed to the drive input gear 58 in the fitted state. Part of the counter-to-gear portion 61 is protruded in the fitting direction from a fitting-direction downstream-side end portion of the side face portion 54. This protruded portion of the counter-to-gear portion 61 has a circular-arc shape, as viewed in an axial plan view, along an outer circumferential surface of the drive input gear 58. In the fitted state, the fitting-direction downstream-side end portion (above-mentioned protruded portion) of the counter-to-gear portion 61 is located forward of the drive input gear 58.

As shown in FIGS. 4 and 7, a plurality of engaging protrusions 57 protruded in the fitting direction are provided at fitting-direction downstream-side end edges of the upper face portion 52 and the lower face portion 53 in the cover member 50. Each engaging protrusion 57 (claw portion) has a fitting-direction downstream-side end portion formed into a claw shape.

Engageable recessed portions 68 are formed in lower portion of the flat portion 62 and upper portion of the container opening 60 in the development container 36. Each engageable recessed portion 68 is recessed so as to be engageable with the claw shape of the fore end portion of the engaging protrusion 57. The engaging protrusions 57 and the engageable recessed portions 68, based on engagement of the claw shape of each engaging protrusion 57 with the engageable recessed portion 68, make up a snap fit mechanism (engaging mechanism) that allows the cover member 50 and the development container 36 to be removably coupled to each other.

A grip portion 59 formed into a circular-arc shape in a plan view and projected upward and rearward is provided in the upper face portion 52. A user is allowed to hold the grip portion 59 to fit and remove the cover member 50 to and from the development container 36.

As described above, with the cover member 50 fitted to the development container 36, gaps are formed between the upper end portions 43 of the reinforcing ribs 56 and the development container 36. Therefore, under the condition that the cover member 50 has been fitted to the development container 36, even when vibrations or shocks have struck the cover member 50, the vibrations or shocks are less likely to be transmitted to the development container 36.

Accordingly, there can be provided a developing device 33 capable of suppressing outflow of the developer with the cover member 50 set in the fitted state.

Also as described above, the counter-to-gear portion 61 of the side face portion 54 and the drive input gear 58 are opposed to each other in the axial direction, and the fitting-direction downstream-side end portion of the counter-to-gear portion 61 is located forward of the drive input gear 58 in the axial direction. Therefore, when the user (including maintenance workers or transport workers) touches the developing device 33 with the cover member 50 fitted thereto, the user is less likely to directly touch vicinities of the drive input gear 58. Since grease or other lubricant has been applied to the drive input gear 58 as described above, adopting a configuration in which the counter-to-gear portion 61 is axially opposed to the drive input gear 58 helps prevent contamination of user's hands.

Also as described above, the shielding portion 19 is provided so as to be protruded upward over an entire range of a longitudinal end edge of the front seal member 65. For this reason, even with waste toner deposited around the container opening 60, when the developing device 33 is oriented downward during its fitting to the body housing 10, the waste toner around the container opening 60 is held back by the shielding portion 19. Therefore, dropping of waste toner into the body housing 10 can be suppressed.

Further as described above, in the state with the cover member 50 fitted to the development container 36, a gap is formed between the shielding portion 19 and the flat face portion 48. Therefore, under the condition that the cover member 50 is fitted to the development container 36, even when vibrations or shocks have struck the cover member 50, the vibrations or shocks are even less likely to be transmitted to the development container 36, so that outflow of the developer can be suppressed more preferably. Also, even with waste toner deposited around the shielding portion 19, the waste toner can be prevented from scattering due to shocks that have struck the cover member 50.

Also as described above, the reinforcing ribs 56 are provided in the coupling portion 44 between the front face portion 51 and the lower face portion 53. Therefore, thermal constriction during molding can be suppressed while the front face portion 51 and the lower face portion 53 are improved in strength.

In addition to the above description, the present disclosure is not limited to the above-described embodiment, and may be modified in various ways unless those modifications depart from the gist of the disclosure. For example, whereas the foregoing embodiment has been described about a monochrome printer as an example of the image forming apparatus 1, the disclosure may also be applied to tandem- or rotary-type color printers as an example. Further, the disclosure may be applied to image forming apparatuses such as copiers, facsimiles or multifunction peripherals equipped with their functions as well.

Further, although the developer is assumed as nonmagnetic one-component developer composed of toner alone in the above-described embodiment, yet a two-component developer with use of toner and carrier may also be adopted.

The present disclosure is applicable to developing devices which fulfill development with use of developer containing toner. By virtue of exploiting the disclosure, outflow of the developer from the development container can be suppressed during transport or storage of the developing device.

What is claimed is:

1. A developing device comprising:

a development container having an opening and internally containing developer including toner;

a developer carrier which is rotatably supported by the development container and has a development area where part of an outer circumferential surface carrying the developer is exposed from the opening, and which feeds the toner to an image carrier in the development area; and a cover member which is fittable to and removable from the development container and protects the outer circumferential surface of the developer carrier exposed from the opening, wherein the cover member includes:

a front face portion which is opposed to an entire range of the developer carrier in its rotation-axial direction;

an upper face portion which is erectly provided over a range from a side end portion of the front face portion extending along its rotation-axial direction toward the development container;

a lower face portion which is erectly provided over a range from the side end portion of the front face portion extending along the rotation-axial direction toward the development container, and which is opposed to the upper face portion with the developer carrier interposed therebetween;

a side face portion which is erectly provided over a range from one end edge of the front face portion in the rotation-axial direction toward the development container; and a reinforcing rib which is formed in a coupling portion between the lower face portion and the front face portion, the cover member being removably fitted to the development container in such fashion that the developer carrier is covered with at least the front face portion and the upper face portion, and under a condition that the cover member is fitted to the development container, a gap is formed between the reinforcing rib and the development container.

2. The developing device according to claim 1, further comprising a drive input gear which is coupled to a rotating shaft of the developer carrier from outside of the development container, and which inputs rotation driving force to the developer carrier, wherein the side face portion is opposed to the drive input gear in the rotation-axial direction.

3. The developing device according to claim 1, further comprising:

a seal member which is placed at a position between the developer carrier and the front face portion in its radial direction of the developer carrier so as to extend along the rotation-axial direction and block a gap between the developer carrier and the opening; and a shielding portion which is protruded upward over an entire range of an end edge on one side farther from the developer carrier out of side end portions of the seal member in the rotation-axial direction, wherein under a condition that the cover member is fitted to the development container, a gap is formed between the front face portion and the shielding portion.

4. The developing device according to claim 3, wherein the shielding portion is sponge.

5. The developing device according to claim 1, further comprising an engaging mechanism including a plurality of claw portions protruded from the cover member toward the development container, and a plurality of engageable recessed portions formed in the development container and removably engageable with the claw portions, respectively.

6. The developing device according to claim 1, wherein the developer is nonmagnetic one-component developer composed of nonmagnetic toner alone.

7. An image forming apparatus comprising:

an apparatus body;

an image carrier provided inside the apparatus body and having an outer circumferential surface on which an electrostatic latent image is to be formed; and the developing device according to claim 1, which is removably provided inside the apparatus body with the cover member removed, and in which, with the developing device fitted inside the apparatus body, the developer carrier is placed in contact with or proximity to the outer circumferential surface of the image carrier to develop the electrostatic latent image into a toner image.

* * * * *